US007441854B2

(12) United States Patent
Jahana et al.

(10) Patent No.: US 7,441,854 B2
(45) Date of Patent: Oct. 28, 2008

(54) INK JET PRINT HEAD, INK JET PRINTING APPARATUS, AND METHOD FOR MANUFACTURING INK JET PRINT HEAD

(75) Inventors: Ryoki Jahana, Kanagawa (JP); Ayako Uji, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 11/447,161

(22) Filed: Jun. 6, 2006

(65) Prior Publication Data

US 2006/0279606 A1 Dec. 14, 2006

(30) Foreign Application Priority Data

Jun. 9, 2005 (JP) ..... 2005-170011

(51) Int. Cl.
*B41J 29/393* (2006.01)

(52) U.S. Cl. ..... 347/14; 347/19

(58) Field of Classification Search ..... 347/13, 347/42, 19, 77, 14, 11, 12
See application file for complete search history.

(56) References Cited

U.S. PATENT DOCUMENTS

| | | | | |
|---|---|---|---|---|
| 6,655,771 | B2 * | 12/2003 | Matsumoto et al. | 347/13 |
| 6,764,164 | B2 | 7/2004 | Kuwahara | |
| 7,021,732 | B2 * | 4/2006 | Folkins | 347/8 |
| 2006/0274100 | A1 | 12/2006 | Uji et al. | |

FOREIGN PATENT DOCUMENTS

| | | |
|---|---|---|
| JP | 5-57965 | 3/1993 |
| JP | 2002-254649 | 9/2002 |

* cited by examiner

*Primary Examiner*—Lamson D Nguyen
(74) *Attorney, Agent, or Firm*—Fitzpatrick, Cella, Harper & Scinto

(57) ABSTRACT

The present invention is able to print high-grade images by reducing the adverse effect of misdirection of ink in the joining portion between adjacent nozzle lines. To achieve this, an ink jet print head includes a plurality of chips in each of which adjacent nozzle lines are formed. The relative positions of the chips are set depending on the amounts of misdirection of ink ejected from overlapping nozzles in the joining portion.

1 Claim, 6 Drawing Sheets

INK JET PRINT HEAD, INK JET PRINTING APPARATUS, AND METHOD FOR MANUFACTURING INK JET PRINT HEAD

BACKGROUND OF THE INVENTION

1. Field of the Invention

The present invention relates to an ink jet print head having a plurality of nozzles which are arranged in a plurality of lines and from which ink can be ejected, an ink jet printing apparatus using the ink jet print head, and a method for manufacturing the ink jet print head.

2. Description of the Related Art

Printing apparatuses based on an ink jet system (ink jet printing apparatuses) have been applied to many printers, facsimile machines, copiers, and the like; the ink jet system causes ink to be ejected from nozzles arranged in an ink jet print head to print images on print media. In particular, color printers capable of printing color images using a plurality of color inks are commonly used owing to the improved quality of images obtained.

In addition to the improved quality of printed images, an increase in print speed is important to the ink jet printing apparatuses. Much effort has been made to increase the print speed by increasing the driving frequency with which ink is ejected from the print head as well as the number of nozzles arranged in the print head. A technique for sharply increasing the print speed involves, for example, increasing the length of the print head and the density at which the nozzles are arranged and printing an image by means of a single scan, which previously required a plurality of scans to complete.

As a method for increasing the length of the print head, arranging a plurality of print heads in a line is excellent for a reduction in manufacture costs. Specifically, if each print head is composed of chips comprising print elements (including nozzles), a long print head is constructed by arranging a number of chips corresponding to a plurality of original print heads. In the description below, the joining portion between the chips comprising the print elements corresponds to the joining portion between the print heads.

An image defect like a white stripe is likely to occur in that part of a printed image which corresponds to the joining portion between the print heads. This is because an air current generated between the print head and a print medium causes ink droplets ejected from an end of a nozzle line to impact the print medium at a position corresponding to the inside of the nozzle line instead of the correct position (this phenomenon is also referred to as an "end misdirection").

To correct the deviation of the ink droplet impacting position caused by the end misdirection in a serial scan type ink jet printing apparatus, it is possible to gradually increase the pitch between nozzles located near the end of the nozzle line. Other possible causes of a stripe-like image defect include a difference in the amount of ink ejected among the nozzles, the accuracy with which the chips are arranged in a line, and a variation in the time when ink droplets impact the print medium.

As a technique for preventing a stripe-like image defect in that part of the printed image which corresponds to the joining portion between the print heads, a method of allowing the two sets of nozzles in the respective print heads to overlap each other in the joining portion has been proposed in, for example, Japanese Patent Application Laid-Open No. 5-57965.

The print heads with the overlapping nozzles suppress generation of a large white stripe. However, the ink droplet impacting position still deviates as a result of the end misdirection. A thin white stripe may thus appear in that part of the printed image which corresponds to the area in which the two sets of nozzles overlap. This stripe may be recognized as an image defect. This is particularly marked if glossy paper or the like which is suitable for printing high-quality images is used as the print medium.

If the pitch between the nozzles located near the end of the nozzle line is changed to correct the deviation of the ink droplet impacting position, an exposure mask or the like which is used in the process of producing nozzles must be changed. This sharply increases the manufacture costs of the print heads.

SUMMARY OF THE INVENTION

The present invention can provide an ink jet print head, an ink jet printing apparatus, and a method for manufacturing an ink jet print head which enable high-grade images to be printed while reducing the adverse effect of misdirection of ink in a joining portion between adjacent nozzle lines.

In a first aspect of the present invention, there is provided an ink jet print head comprising a plurality of nozzles which are arranged in a plurality of lines and from which ink can be ejected, two sets of a predetermined number of nozzles, in a joining portion of the respective adjacent nozzle lines, overlapping each other in a direction crossing the nozzle lines, wherein relative positions of the adjacent nozzle lines are set depending on the amount of misdirection of ink ejected from the nozzles located in the joining portion.

In a second aspect of the present invention, there is provided an ink jet printing apparatus capable of printing an image on print medium by using an ink jet print head comprising a plurality of nozzles which are arranged in a plurality of lines and from which ink can be ejected, the ink jet print head and the print medium being moved relative to each other in a direction crossing the nozzle lines while allowing the ink jet print head to eject ink, wherein the ink jet print head described in the first aspect is used as the ink jet print head, and the ink jet printing apparatus further comprises control means for selectively using overlapping nozzles in the joining portion.

In a third aspect of the present invention, there is provided a method for manufacturing an ink jet print head comprising a plurality of nozzles which are arranged in a plurality of lines and from which ink can be ejected, two sets of a predetermined number of nozzles, in a joining portion of the respective adjacent nozzle lines, overlapping each other in a direction crossing the nozzle lines, wherein relative positions of the adjacent nozzle lines are set depending on the amount of misdirection of ink ejected from the nozzles located in the joining portion.

The present invention sets the relative positions of adjacent nozzle lines on the basis of the amount of misdirection of ink ejected from the nozzles located in the joining portion between the adjacent nozzle lines. This makes it possible to print high-grade images while reducing the adverse effect of misdirection of ink in the joining portion between the nozzle lines.

During the manufacture of an ink jet print head, it is only necessary to set the relative positions of the adjacent nozzle lines. This enables the ink jet print head to be easily manufactured without significantly increasing the manufacture costs.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below with reference to the drawings.

First Embodiment

Figure 1:
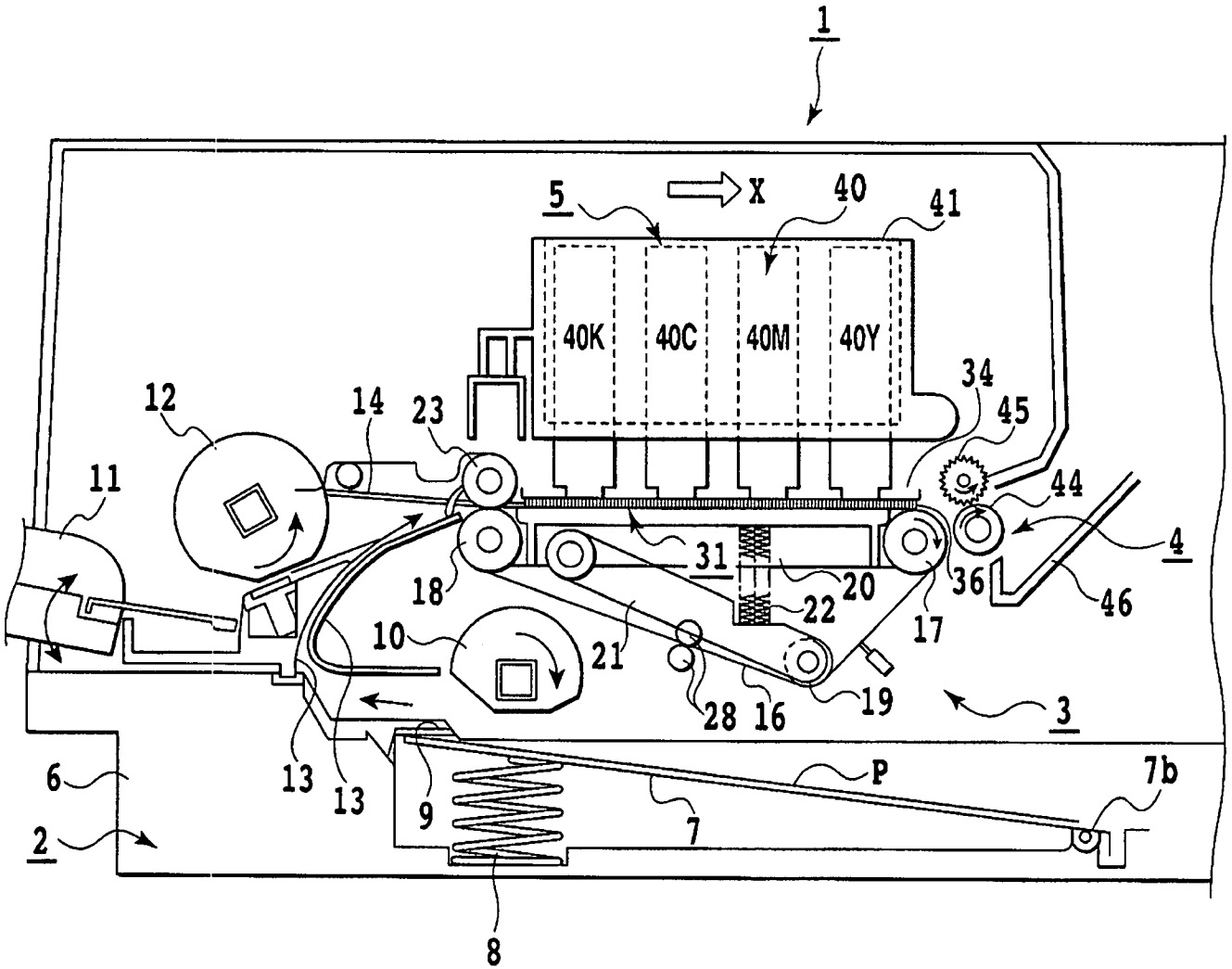
FIG. 1 is a diagram showing the general configuration of an ink jet printing apparatus to which the present invention is applicable.

FIG. 1 is a sectional view of an ink jet printing apparatus to which the present invention is applicable.

A printing apparatus 1 in the present example has an automatic feeding device, a feeding section 2, a printing section 5, and a discharging section 4.

The feeding section is composed of a platen 7 on which print sheets P as print media are stacked and a feeding roller 10 that feeds each of the print sheets P; the platen 7 and the feeding roller 10 are provided in a base 6. The platen 7 is rotatable around a rotating shaft 7*b* coupled to the base 6. The platen 7 is urged toward the feeding roller 10 by a platen spring 8. The base 6 is provided with a separating pawl 9 that separates each of the print sheets P on the platen 7. Each of the print sheets P on the platen 7 is picked up as the feeding roller 10 rotates and is separated by the separating pawl 9 and fed to the conveying section 3. A hand tray 11 is provided on a side of the printing apparatus 1. Print sheets P stacked on the hand tray 11 are each fed by a hand feeding roller 12 rotated in accordance with a print instruction signal from a computer or the like. The print sheet P is then guided to the conveying section 3 by a lower guide 13 and an upper guide 14.

The conveying section 3 comprises a conveying belt 16 that conveys the print sheet P while sucking it. The conveying belt 16 is wound around a downstream driving roller 17, an upstream conveying roller 18, and a pressure roller 19. The pressure roller 19 is rotatably attached to one end of an arm 21 the other end of which is pivotably attached to a platen 20. The pressure roller 19 tenses the conveying belt 16 under the urging force of a spring 22. A pinch roller 23 sandwiches the print sheet P between itself and the conveying belt 16 to convey it to the printing section 5.

The printing section 5 comprises a releasable full line type ink jet print head 40. A plurality nozzles in the print head 40 are arranged across the width of the print sheet P in a direction orthogonal to a direction X in which the print sheep P is conveyed. The print head 40 comprises a print head 40K that ejects black ink, a print head 40C that ejects cyan ink, a print head 40M that ejects magenta ink, and a print head 40Y that ejects yellow ink. These print heads are mounted in a head holder 41 and are arranged at predetermined intervals in order of the print heads 40K, 40C, 40M, and 40Y from an upstream side in the print sheet P conveying direction.

The discharging section 4 includes a discharging roller 44 and a spur 45. The print sheet P on which an image has been formed by the printing section 5 is conveyed by the discharging roller 44 and spur 45 and discharged onto a discharging tray 46.

Figure 2:
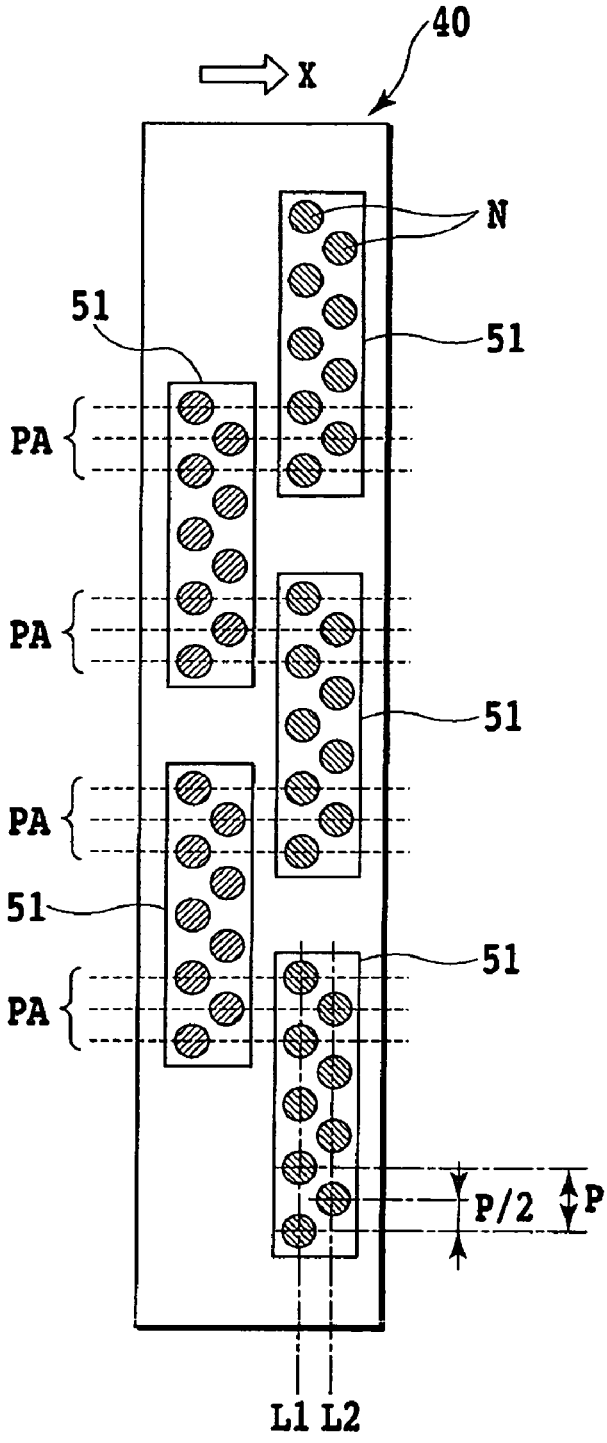
FIG. 2 is a diagram showing the general configuration of a print head provided in the printing apparatus in FIG. 1.

FIG. 2 is a diagram showing the general configuration of the ink jet print head 40, used in the printing apparatus 1 in FIG. 1.

The print head 40 in the present example has a plurality of (in the present example, four) chips 51 arranged in a line and comprising print elements. Nozzles N comprising ejection energy generating means are formed in each of the chips 51 as print elements. The nozzles N in each chip 51 are formed at predetermined pitches P along two rows L1 and L2. Each of the nozzles in the row L1 is offset from the corresponding nozzle in the row L2 by half the pitch (P/2). In a joining portion PA between the adjacent chips 51, two sets of a predetermined number of nozzles N in these chips 51 overlap each other in the scanning direction of arrow X (print sheet P conveying direction). In FIG. 2, for the convenience of description, each chip 51 has nine nozzles and two sets of three nozzles in the adjacent chips overlap each other in the joining portion PA. In the description below, the joining portion PA between the chips 51 is referred to as the junction portion in the print head.

The nozzle N located at an end of each chip 51 is likely to undergo the "end misdirection" phenomenon. Specifically, ink droplets ejected from the nozzle N located at the end of the chip 51 are likely to impact the print sheet P at a position corresponding to the inside of the chip 51 owing to an air current generated between the print head 40 and the print sheet P. The "end misdirection" may cause a thin, stripe-like image defect (white stripe) in that part of the printed image which corresponds to the joining portion PA. The occurrence of a reduced-density area means the possibility of occurrence of a thick, stripe-like image defect (black stripe). In the description below, these white and black stripe-like image defects are sometimes simply referred to as "stripes".

Figure 3:
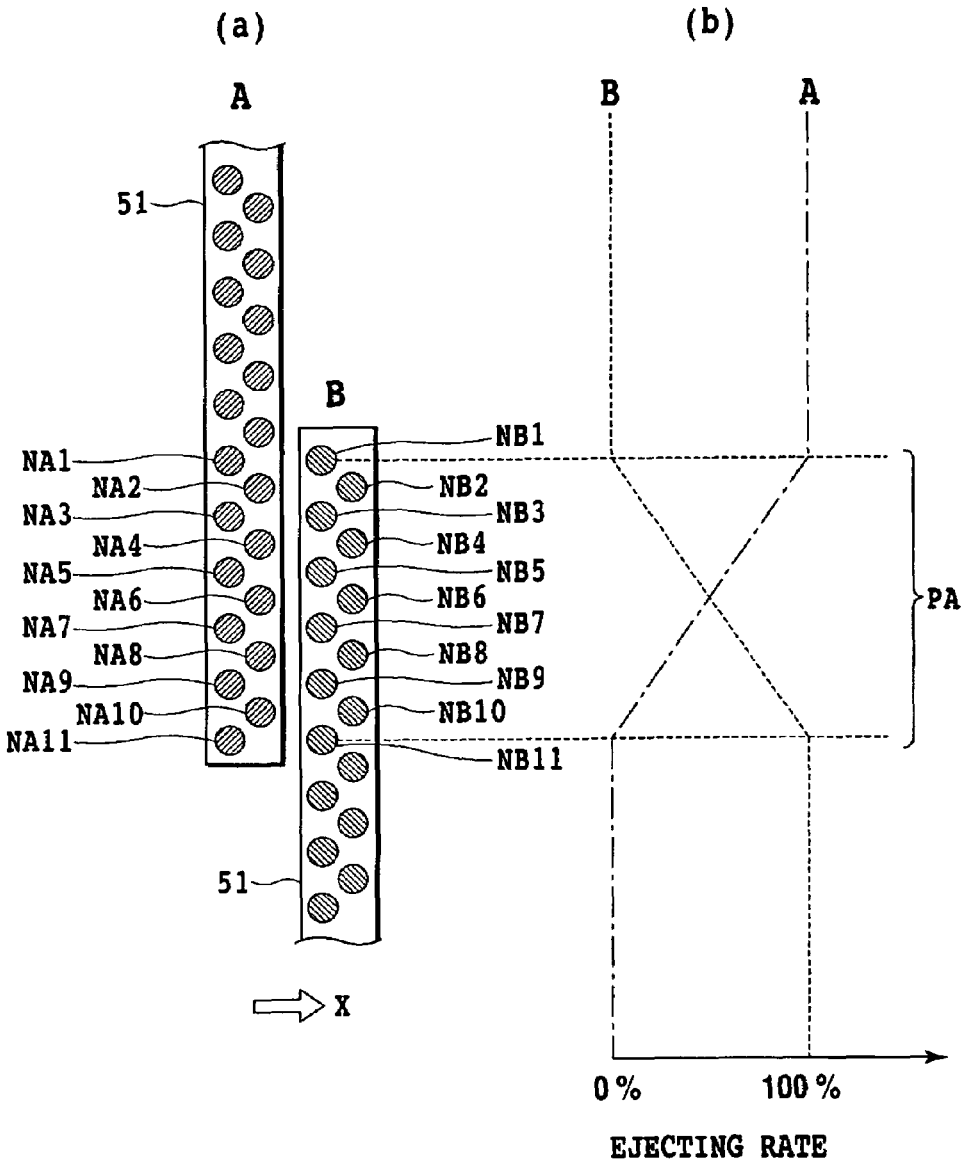
FIG. 3 is a diagram illustrating the relationship between a joining portion in the print head in accordance with the first embodiment of the present invention and the ink ejecting rate in the joining portion.

FIG. 3 illustrates the specific configuration of the ink jet print head in accordance with the first embodiment of the present invention. In the present example, two sets of 11 nozzles in the adjacent chips overlap each other in the joining portion PA.

In the case of (a) of FIG. 3, one of the adjacent chips 51, 51 is defined as a chip A, whereas the other is defined as a chip B. The overlapping nozzles N of the chip A located in the joining portion PA are denoted as NA1 to NA11. The overlapping nozzles N of the chip B located in the joining portion PA are denoted as NB1 to NB11. Each nozzle used is defined to have an ink ejecting rate of 100%. Each nozzle unused is defined to have an ink ejecting rate of 0%. The ejecting rate varies among the nozzles in the joining portion PA.

A method for varying the ejecting rate (also referred to as a "gradation process"), as disclosed in Japanese Patent Application Laid-Open No. 5-57965, involves varying the ejecting rate (use rate) depending on the position of each of the overlapping nozzles in the chips A and B. Specifically, as shown at (b) of FIG. 3, for the chip A, the ink ejecting rate, that is, the dot formation density per unit print area, gradually decreases in order of the nozzles NA1 to NA11. For the chip B, the ink ejecting rate, that is, the dot formation density per unit print area, gradually increases in order of the nozzles NB1 to NB11 so as to supplement the decrease in the dot formation density in the chip A. For example, the ink ejecting ratio of the nozzle NA6 to the nozzle NB6 is 50:50; the nozzle NA6 is responsible for 50% of the image formation, whereas the nozzle NB6 is responsible for the remaining 50%. The nozzles NA1 to NA5 have higher ejecting rates than the nozzles NB1 to NB5. The nozzles NA7 to NA11 have lower ejecting rates than the nozzles NB7 to NB11.

Even with the variation in ejecting rate in the joining portion PA, the occurrence of the "end misdirection" may result in a white stripe-like image defect in that part of the printed image which corresponds to the joining portion PA.

The present embodiment adjusts the relative positions of the chips A and B on the basis of the analysis of the amount of misdirection.

Figure 4:
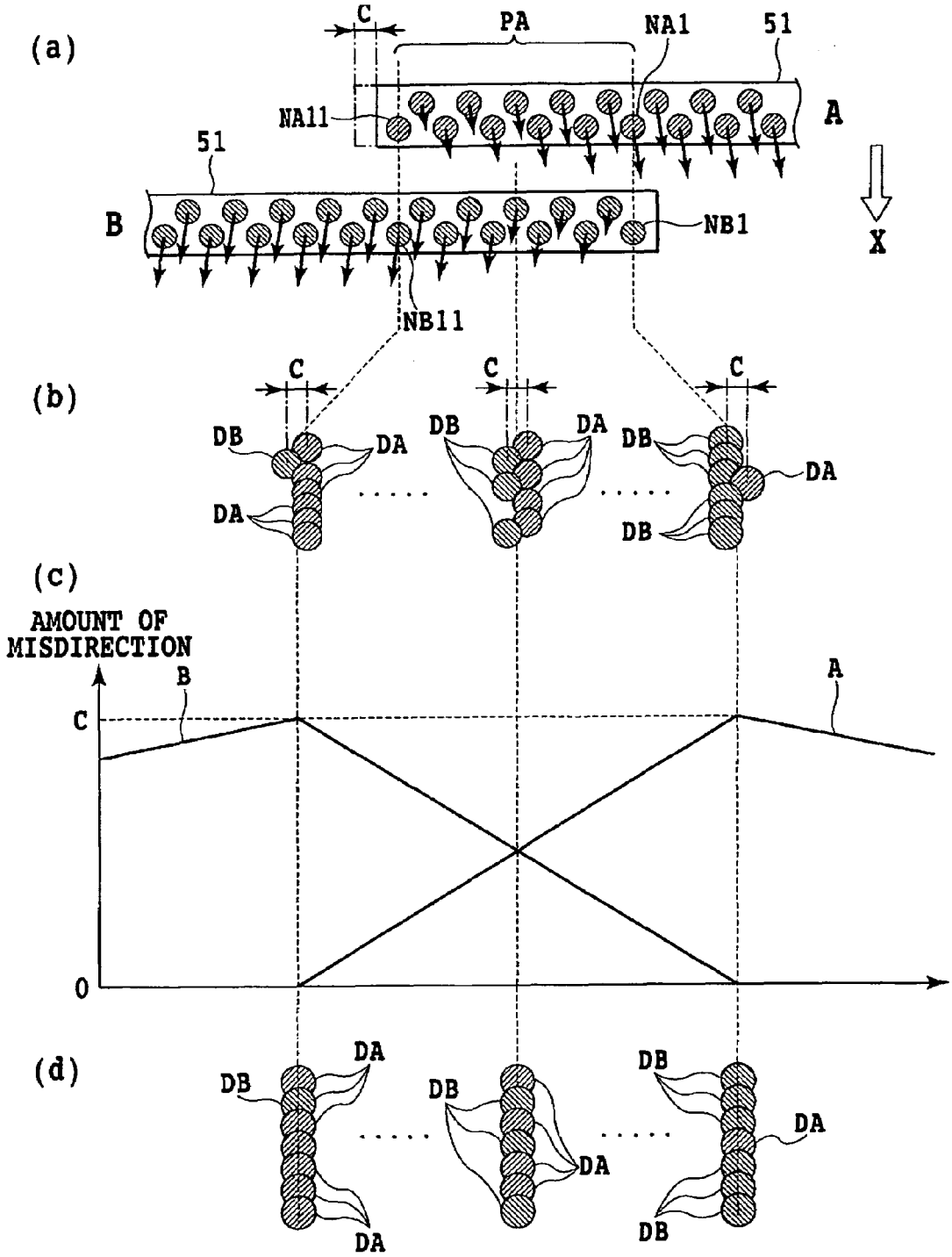
FIG. 4 is a diagram illustrating the relationship among the amount of misdirection of ink droplets ejected from a print head in which overlapping nozzles are not displaced, an example of dots formed using nozzles in a joining portion in the print head, the amount of misdirection of ink droplets ejected from nozzles in the print head, and an example of dots formed using the print head in accordance with the first embodiment of the present invention in which overlapping nozzles are displaced.

In the joining portion PA such as the one shown at (a) of FIG. 4, ink droplets ejected from nozzles located near an end of the chip A, containing the nozzles NA1 to NA11, are misdirected toward an intermediate portion of the chip A under the effect of an air current as shown by arrows. The amount of misdirection of ink droplets ejected from the nozzles NA1 to NA11 gradually decreases in this order depending on the length of the arrow. This is because the ejecting rate of the nozzles NA1 to NA11 gradually decrease in this order, with the adverse effect of the air current correspondingly weakened. Likewise, ink droplets ejected from nozzles located near an end of the chip B, containing the nozzles NB1 to NB11, are misdirected toward an intermediate portion of the chip B under the effect of an air current as shown by arrows. The amount of misdirection of ink droplets ejected from the nozzles NB1 to NB11 gradually increases in this order depending on the length of the arrow. This is because the ejecting rate of the nozzles NB1 to NB11 gradually increases in this order, with the adverse effect of the air current correspondingly enhanced.

When an image of a predetermined print duty, that is, an image of a predetermined gradation level, is printed, the amounts of misdirection of ink droplets ejected from the nozzles in the chips A and B vary as shown at (c) of FIG. 4. Specifically, for the nozzles NA1 to NA11, the amount of misdirection of ink droplets decreases in this order linearly with the ejecting rate. For the nozzles NB1 to NB11, the amount of misdirection of ink droplets increases in this order linearly with the ejecting rate. This causes the impacting positions of ink droplets ejected From the overlapping nozzles to deviate relative to one another by a fixed amount C. In other words, the amounts of relative misalignment of dots formed using the overlapping nozzles are fixed at the value C. The case of (b) of FIG. 4 shows examples of formation of dots. Reference character DA denotes a dot formed using a nozzle in the chip A. Reference character DB denotes a dot formed using a nozzle in the chip B. As shown at (c) of FIG. 4, at a predetermined print duty, the amounts of misalignment of dots DA and DB in the nozzle arranging direction are fixed at the value C.

On the basis of analysis of the amount of misdirection of ink droplets, the present embodiment adjusts the relative positional relationship between the chips A and B during the manufacture of the print head 40. Specifically, as shown by an alternate long and two short dashes line at (a) of FIG. 4, the print head 40 is assembled so that the relative positions of the chips A and B are displaced by the amount C. At a predetermined print duty involving misalignment in the amount C as shown at (c) of FIG. 4, the thus assembled print head 40 can reduce the amounts of misalignment of the dots DA and DB as shown at (d) of FIG. 4.

The relative positions of the chips A and B are desirably displaced by the amount C corresponding to the print duty at which the most noticeable stripe appears in that part of the printed image which corresponds to the joining portion PA. In other words, the adjacent chips A and B are pre-displaced with respect to each other by the amount C corresponding to the print duty involving the most noticeable stripe. This enables the amount of misdirection to be most effectively reduced at that print duty to make the stripe unnoticeable. Naturally, possible stripes are made unnoticeable at other print duties.

A possible print duty involving the most noticeable white stripe corresponds to the gradation level at which optical density varies most significantly depending on the amount of ink ejected, in a print area of a relatively high density.

Figure 5:
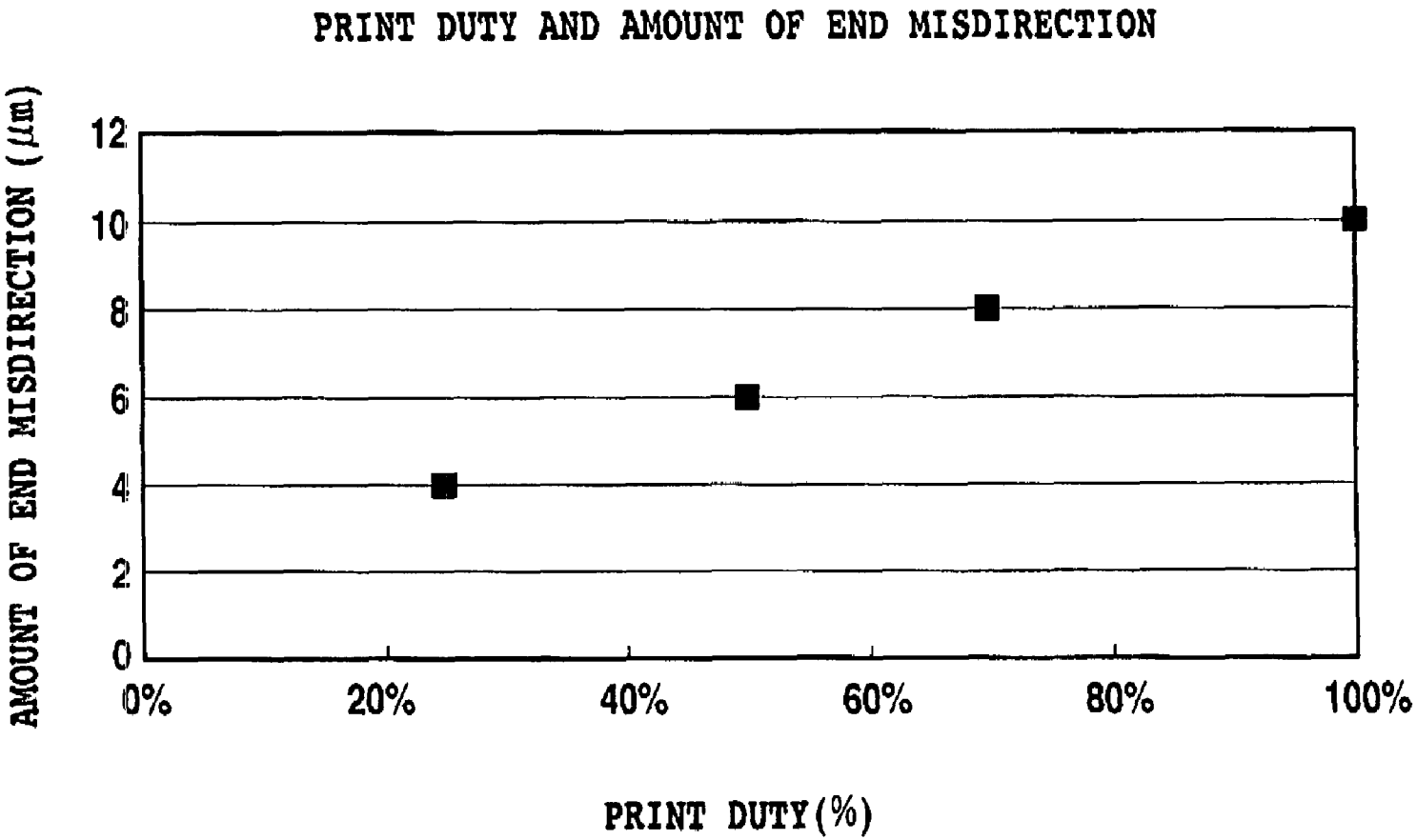
FIG. 5 is a diagram illustrating measurements of the relationship between the maximum amount of end misdirection and print duty.

FIG. 5 is a diagram illustrating the relationship between the print duty and the maximum amount of end misdirection under predetermined driving conditions. Under these driving conditions, a print head was used which had 512 nozzles arranged at 1,200 dpi and which ejected 5 pl (pico litter) of ink droplets. The driving frequency (ejection frequency) of the print head was set at 20 kHz. The distance between the print head and the print medium (also referred to as a "sheet distance") was set at 1.2 mm. In the example shown in FIG. 5, the gradation level involving the most noticeable stripe corresponded to the neighborhood of a print duty of 50%. The maximum amount of end misdirection was 6 μm. In this case, the adjacent chips in the print head are displaced with respect to each other so that the two sets of overlapping nozzles are arranged closer to each other by 3 μm. This enables a high-grade image to be printed while making a possible band-like white stripe unnoticeable. Setting the amount of displacement of the chips as described above is also effective at a print duty of a value other than 50%, though the effect at a print duty of a value other than 50% is lower than that at a print duty of 50%.

Second Embodiment

Figure 6:
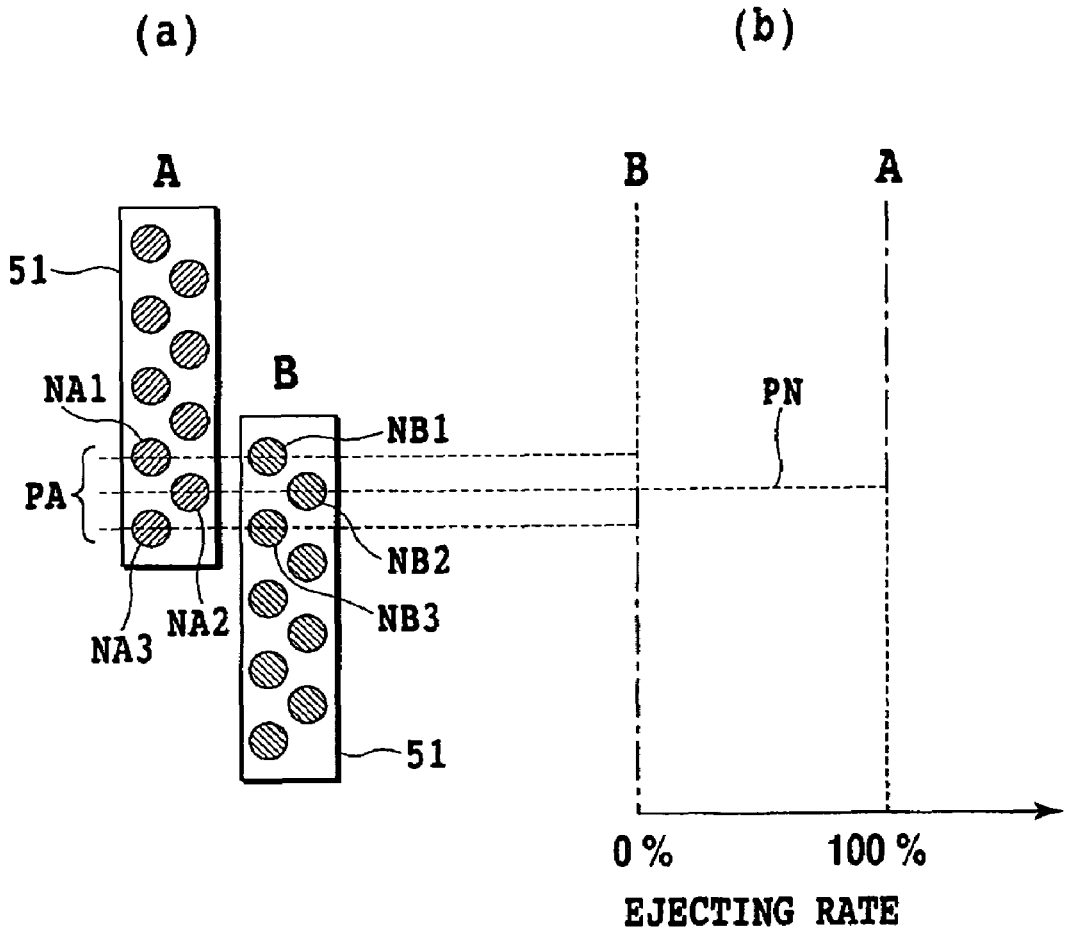
FIG. 6 is a diagram illustrating the relationship between a joining potion in a print head in accordance with a second embodiment of the present invention and the ink ejecting rate in the joining portion in the print head.

FIG. 6 is a diagram illustrating the specific configuration of the ink jet print head 40 in accordance with a second embodiment of the present invention. In the present example, two sets of three nozzles overlap each other in the joining portion PA.

As shown at (a) of FIG. 6, one of the adjacent chips 51, 51 is defined as a chip A, whereas the other is defined as a chip B. The overlapping nozzles N of the chip A located in the joining portion PA are denoted as NA1, NA2, and NA3. The overlapping nozzles N of the chip B located in the joining portion PA are denoted as NB1, NB2, and NB3. Each nozzle used is defined to have an ink ejecting rate of 100%. Each nozzle unused is defined to have an ink ejecting rate of 0%. The ejecting rate is set as shown at (b) of FIG. 6. The nozzles NA1 and NA2 in the chip A and the nozzle NB3 in the chip B are used, whereas the nozzle NA3 in the chip A and the nozzles NB1 and NB2 in the chip B are unused. Thus, the nozzle joining portion between the chips A and B is located at a position PN.

If this print head is subjected to end misdirection similar to that shown in FIG. 5, previously described, a white stripe may appear in the print area corresponding to the joining portion PA. In the example shown in FIG. 5, the gradation level involving the most noticeable stripe corresponded to the neighborhood of a print duty of 50%, and the maximum amount of end misdirection was 6 μm, as previously described. In this case, impacting misalignment of 12 μm may result in a gap between the nozzle in the chip A and the nozzle in the chip B both of which are located at the joining position PN. The gap may appear to be a white stripe. Accordingly, the adjacent chips are displaced so that the two sets of overlapping nozzles are arranged closer to each other by 6 μm. Thus, in particular, a possible band-like white stripe can be made unnoticeable.

However, the width of such a white stripe varies with the print duty. Thus, if the amount of displacement of the adjacent chips is set on the basis of the amount of misdirection at a print duty of 50%, a black stripe-like image defect may occur in a low-density print area with a print duty of 50% or lower. The amount of displacement of the chips is desirably set on the basis of a value smaller than 6 μm, that is, the amount of misdirection at a print duty slightly lower than the one involving the most noticeable stripe.

Other Embodiments

The present invention is applicable not only to a full line type printing system such as the one shown in FIG. 1, that is, a system of continuously printing an image while moving the print head and the print medium relative to each other in one direction, but also to a serial scan system. The serial scan printing system involves the movement of the print head in the main scanning direction and the conveyance of the print medium in the sub-scanning direction.

To allow the print head to eject ink droplets, various systems using electrothermal converter (heater), piezo element, or the like can be adopted. The electrothermal converter can generate heat to bubble ink, so that the resulting bubbling energy can be used to eject ink from the nozzle.

The number of nozzle lines formed in one chip is not limited to two as previously described. Only one nozzle line or three or more nozzle lines may be formed in one chip. In short, it is only necessary to form overlapping nozzles. The nozzle lines having overlapping nozzles may be formed in a single chip.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2005-170011 filed Jun. 9, 2005, which is hereby incorporated by reference herein.

What is claimed is:

1. An ink jet printing apparatus capable of printing an image on print medium by using an ink jet print head comprising a plurality of nozzles which are arranged in a plurality of lines and from which ink can be ejected, relative movement between the ink jet print head and the print medium being effected in a direction crossing the nozzle lines while allowing the ink jet print head to eject ink, wherein in the ink jet print head two sets of a predetermined number of nozzles, in a joining portion of respective adjacent nozzle lines, overlap each other in the direction crossing the nozzle lines, and relative positions of the adjacent nozzle lines are set depending on the amount of misdirection of ink ejected from the nozzles located in the joining portion, wherein the ink jet printing apparatus further comprises control means for selectively using overlapping nozzles in the joining portion, and wherein the control means sets a reference direction from one end of one of the adjacent nozzle lines toward the other end, and controls the overlapping nozzles so that a print density of dots formed using one of the nozzle lines in the joining portion gradually decreases in the reference direction, while the print density of dots formed using the other nozzle line in the joining portion gradually increases in the reference direction.

* * * * *